United States Patent [19]

Salentine

[11] Patent Number: 4,459,215

[45] Date of Patent: Jul. 10, 1984

[54] SYNERGISTIC COMBINATION OF ALKALI METAL BORATES, SULFUR COMPOUND, AND ZIRCONIUM SALT

[75] Inventor: Christopher G. Salentine, Mill Valley, Calif.

[73] Assignee: Chevron Research Company, San Francisco, Calif.

[21] Appl. No.: 490,072

[22] Filed: Apr. 29, 1983

[51] Int. Cl.[3] ..... C10M 1/38; C10M 1/54

[52] U.S. Cl. ..... 252/32.5; 252/32.7 E; 252/33.6; 252/49.6

[58] Field of Search ..... 252/32.5, 32.7 E, 33.6, 252/49.6

[56] References Cited

U.S. PATENT DOCUMENTS

| | | | |
|---|---|---|---|
| 4,171,268 | 10/1979 | Collins et al. | 252/32.7 E |
| 4,263,155 | 4/1981 | Frost | 252/49.6 |
| 4,384,967 | 5/1983 | Salentine et al. | 252/49.6 |

*Primary Examiner*—Jacqueline V. Howard

*Attorney, Agent, or Firm*—D. A. Newell; J. M. Whitney; J. J. DeYoung

[57] ABSTRACT

Disclosed is a lubricating composition comprising an oil of lubricating viscosity having dispersed therein a minor amount of an additive composition comprising a mixture of: (a) a hydrated alkali metal borate; (b) an oil-soluble sulfur-containing compound; and (c) a zirconium salt.

8 Claims, No Drawings

SYNERGISTIC COMBINATION OF ALKALI METAL BORATES, SULFUR COMPOUND, AND ZIRCONIUM SALT

BACKGROUND OF THE INVENTION

The invention relates to extreme pressure lubricating oils, particularly alkali metal borate-containing lubricants.

Alkali metal borates are well known in the lubricant industry for their usefulness as extreme pressure agents. See, for example, U.S. Pat. Nos. 3,313,727; 3,565,802; 3,819,521; 3,846,313; 3,853,772; 3,907,691; 3,912,639; 3,912,643; 3,912,644; 3,997,454; and 4,089,790.

U.S. Pat. No. 4,089,790 claims a synergistic lubricant mixture containing: (1) a hydrated potassium borate; (2) an antiwear agent selected from (a) zinc dihydrocarbyl dithiophosphate, (b) $C_1$–$C_{20}$ ester, $C_1$ to $C_{20}$ amide or $C_1$ to $C_{20}$ amine salt of a dihydrocarbyl dithiophosphoric acid, (c) zinc alkyl aryl sulfonate, and (d) mixture thereof; and (3) oil soluble antioxidant organic sulfur compound.

U.S. Pat. No. 4,171,268 claims lubricant compositions containing a zirconium salt of a carboxylic acid and oil-soluble sulfur-containing extreme pressure agent.

It is one object of the invention to provide an alkali metal borate-containing lubricant which has superior load carrying properties.

SUMMARY OF THE INVENTION

It has been found that a lubricating oil containing: (1) an alkali metal borate; (2) an oil-soluble sulfur compound; and (3) a zirconium salt interact synergistically to provide a lubricant with superior load carrying properties. Preferably the lubricating oil also contains an amine salt of a phosphate and/or monothiophosphate.

DETAILED DESCRIPTION OF THE INVENTION

As previously discussed, it is known in the lubricants art to combine alkali metal borate additives with sulfur-containing phosphorus additives, such as the zinc dialkyl phosphate and particularly the zinc dialkyl dithiophosphates. Generally, this combination has provided a lubricant with superior properties. However, it has now been found that some sulfur-phosphorus additives can actually decrease the load carrying capacity of the borate-containing lubricant. It has also been found that zirconium ester additives also have an adverse effect on the load carrying capacity of alkali metal borate lubricants. But surprisingly, it has been discovered that these two normally load reducing additives, when combined together with an alkali metal borate lubricant, interact with one another and with the borate in a synergistic manner resulting in a lubricant having superior load carrying capacity.

This is particularly surprising in view of the fact that the sulfur-phosphorus compound of the present invention when combined with borate decreases the load carrying capacity and the zirconium esters when combined with borate also decrease the load carrying capacity.

The Alkali-Metal Borates

The hydrated particulate alkali metal borates are well known in the art and are available commercially. Representative patents disclosing suitable borates and methods of manufacture include: U.S. Pat. Nos. 3,313,727; 3,819,521; 3,853,772; 3,907,601; 3,997,454; and 4,089,790, the entire disclosures of which are incorporated herein by reference.

The hydrated alkali metal borates can be represented by the following formula:

$$M_2O.mB_2O_3.nH_2O$$

where M is an alkali metal of atomic number in the range 11 to 19, i.e., sodium and potassium; m is a number from 2.5 to 4.5 (both whole and fractional); and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

The Oil-Soluble Sulfur Compounds

In addition to the borates described above, the lubricating composition of the invention also contains at least one oil-soluble sulfur-containing compound. Any of the known types of organic sulfur compounds which have heretofore been suggested as being useful as extreme pressure agents may be used as a sulfur-containing agent in the invention. These include organic sulfides and polysulfides, sulfurized oils and esters or fatty acids, and mixtures thereof. These sulfur compounds may contain other groups which are beneficial and these include halogen groups.

Examples of organic sulfides and polysulfides which are useful as EP agents include aliphatic and aromatic sulfides and polysulfides such as hexyl sulfide, octadecyl sulfide, butyl disulfide, amyl disulfide, hexyl disulfide, octadecyl disulfide, diphenyl sulfide, dibenzyl sulfide, dixylyl sulfide, diphenyl disulfide, dinaphthyl disulfide, diphenol disulfide, dibenzyl disulfide, bis(-chlorobenzyl) disulfide, dibenzyl trisulfide, dibutyltetrasulfide, sulfurized dipentene and sulfurized terpene.

A preferred class of sulfur-containing additives are those made by reacting sulfur and/or sulfur monochloride with a polyolefin. These polyolefins are obtained by the polymerization of low molecular weight olefins such as propylene, isobutylene, and the like. The polymer molecular weights range from 60 to 6,000, preferably about 300 to 3,000.

Halogenated derivatives of the above sulfides and polysulfides are useful and examples include the chlorinated and fluorinated derivatives of diethyl sulfide and disulfide, dioctyl sulfide, diamyl sulfide and disulfide, diphenyl sulfide and disulfide, and dibenzyl sulfide and disulfide. A more exhaustive listing of sulfur and halogen EP agents which may be used is found in U.S. Pat. No. 2,208,163. Examples of sulfurized oils include sulfurized sperm oil, sulfurized methyl ester of oleic acid, sulfurized sperm oil replacements. Other examples of sulfurized oils include sulfurized methyl linoleate, sulfurized animal and vegetable oils, sulfurized lard oil, and sulfurized cottonseed oil.

The Zirconium Salts

The zirconium salts which are useful as an additive in the compositions of the invention preferably are salts of carboxylic acids or mixtures of carboxylic acids. The preparation of zirconium salts or organic carboxylic acids is well known to those skilled in the art. Hence, many of the zirconium salts have been described and used previously such as, for example, in paint drier systems. At times, such salts have been referred to in the art as soaps. The salts or soaps of zirconium can be prepared as normal or basic salts or soaps by varying the amount of metal reacted with the organic carboxylic acid and by other techniques used in the art to increase the amount of metal reacted with the carboxylic acid which results in overbased products.

Specific examples of the zirconium salts or soaps which are useful in the compositions of the invention include zirconium naphthenate, zirconium neodecanoate, zirconium tallate, zirconium 2-ethylhexoate, etc.

The Oil-Soluble Amine Salts of a Phosphate and/or Monothiophosphate

Phosphorus-containing compounds are also contemplated for use herein. It is preferred that the compositions contain at least one phosphorus compound. The phosphorus compounds are phosphates (sulfur free), monothiophosphate, dithiophosphate or mixtures thereof. Preferred is a mixture of phosphates and monothiophosphates.

The oil-soluble amine salts of the phosphorus compound, i.e., the phosphate and/or monothiophosphate, may be represented by the formula:

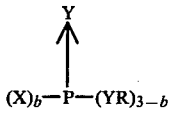

$$(X)_b-\overset{\overset{\Large Y}{\uparrow}}{P}-(YR)_{3-b}$$

wherein:

b is 1, 2, or 3;

Y is O or optionally one or two Y's are S;

R is an oil-solubilizing hydrocarbyl of 1 to 30 carbon atoms; and

X is $-ONH_{4-c}R'_{c'}$ where c is 0, 1, 2, 3, or 4 and R' is a hydrocarbyl group of 1 to 30 carbon atoms or an amino or hydroxy substituted group of 2 to 30 carbon atoms.

The R and R' are alkyl groups which make the phosphorus compound oil-soluble. Generally, in order to provide oil solubility, the number of carbon atoms in all the R groups must be greater than 7. Preferably, the oil-solubilizing groups contain 7 to 70 or more carbon atoms and more preferably, from 12 to 20 carbon atoms. Also, preferred in the above formula, b is 1.

Representative phosphorus-containing compounds having the above structure are sulfur-free phosphates and monothiophosphates, such as:

ammonium dioctyl phosphate;
benzylammonium O,S-diundecyl phosphorothiolate;
tetramethylammonium dibutyl phosphate;
octadecylammonium diethyl phosphate;
pyridinium diethyl phosphate;
di(laurylammonium)methyl phosphate;
stearylammonium dibutyl phosphate;
oleylammonium diethyl phosphate;
cerotylammonium dimethyl phosphate;
myrstylammonium O-butyl S-hexyl phosphorothiolate; and
palmitylammonium di-2-ethylhexyl phosphate.

The lubricating oil to which the borates, sulfur compounds, and zirconium salts are added, can be any hydrocarbon-based lubricating oil or a synthetic-base oil stock. The hydrocarbon lubricating oils may be derived from synthetic or natural sources and may be paraffinic, naphthenic or asphaltic base, or mixtures thereof.

Concentration of Additives

The alkali-metal borate will generally comprise 0.1 to 60 weight percent of the lubricant composition, preferably 0.5 to 15.0 weight percent, and more preferably 2.0 to 9.0 weight percent. The oil-soluble sulfur compounds will comprise 0.06 to 6.0 weight percent of the lubricant composition, preferably 0.15 to 3.0, and more preferably 0.30 to 2.0 weight percent. The zirconium salt will comprise 0.01 to 10.0 weight percent of the lubricant composition, preferably 0.05 to 5.0 weight percent, and more preferably 0.10 to 1.0 weight percent. The oil-soluble phosphorus compounds will comprise 0.03 to 3.0 weight percent of the lubricant composition, preferably 0.07 to 1.5, and more preferably 0.15 to 0.9 weight percent.

Other Additives

A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Preferred dispersants include the well known succinimide and ethoxylated alkylphenols and alcohols but exclude the zinc alkyl aryl sulfonates. Particularly preferred additional additives are the oil-soluble succinimides and oil-soluble alkali or alkaline earth metal sulfonates.

EXAMPLES

The efficiency of the composition of this invention to impart load-carrying properties to lubricants is shown by the well known Timken OK Load test (ASTM D2782) which measures the load (between 0 and 100 pounds) at which the rupture of a film of the lubricant between the rotating cup and a stationary block takes place. The surface distress (e.g., scoring, abrasion) of the stationary block is measured. Thus, the higher the load, the better the load-carrying properties of the lubricant. The results are shown in Table I. In all the Examples the base oil met the requirements of viscosity grade 80W-90 and consisted of a blend of Exxon 150 bright stock and Exxon 100 neutral oil with added pour point depressants.

Additive A consisted of a blend containing 8.7 weight percent of potassium triborate, 1.0 weight percent of a diparaffin polysulfide, 0.5 weight percent zinc dialkyldithiophosphate, and 0.5 weight percent of a phenolic antioxidant.

Additive B consisted of a sulfurized polyolefin containing a phosphorus compound obtained from Edwin-Cooper known as Hitec E-320. From laboratory analysis it is believed to consist of 62 weight percent of a sulfurized polybutene, 10.4 percent phosphates, 17.6 percent monothiophosphates, and 10 percent rust inhibitors, diluents, etc. Most of the phosphorus is present as the oleylamine salt of a mixture of dibutylthiophosphate and dibutylphosphate.

Additive C consisted of a zirconium salt additive obtained from Mooney Chemicals, Inc., Cleveland, Ohio, known as Mooney 320. It is believed to contain zirconium 2-ethylhexoate.

It should be observed that the exact composition of these above described formulations is not generally made public by the manufacturers of the respective compositions and can be at best only approximated analytically by considerable effort. Nevertheless, the presence of certain functional groups can be established with relative certainty and to a degree sufficient to illustrate the effectiveness of the compositions of this invention relative to previously described compositions. In addition, these compositions and information regarding their use are, of course, available from the respective manufacturers noted above.

TABLE I

| Example | Additive[1] | Timken OK Load, Lbs. | Change From A Alone |
|---|---|---|---|
| 1 | None | 0 | −80 |
| 2 | A | 80 | |
| 3 | A + B | 55 | −25 |
| 4 | A + C | 70 | −10 |
| 5 | B + C | 50 | −30 |
| 6 | A + B + C | 85 | +5 |

[1]A at a conc. of 11%;
B at a conc. of 0.65%; and
C at a conc. of 0.5%.

Comparison of Examples 1 and 2 indicates that the alkali metal borate additive dramatically increases the extreme pressure properties of the base oil.

Comparison of Examples 2 and 3 indicates that the sulfur phosphorus additive lowers the extreme pressure properties of the borate containing oil.

Comparison of Examples 2 and 4 indicates that the zirconium ester also lowers the extreme pressure properties of the borate-containing oil.

Comparison of Examples 1 and 5 indicates that the composition of U.S. Pat. No. 4,171,268 gives a modest improvement in the Timken OK load.

Comparison of Examples 1 through 5, with 6 indicates that although either the zirconium additive alone or the sulfur-phosphorus additive alone with borate cause a decrease in performance, when combined together with borate they surprisingly cause an increase in performance. The alkali metal borate interacts in a synergistic manner with a combination of a sulfurized olefin additive and a zirconium ester additive to give an increase in the extreme pressure properties of the fluid.

What is claimed is:

1. A lubricating composition comprising an oil of lubricating viscosity having dispersed therein a minor amount of an additive composition comprising a mixture of:

(a) a hydrated alkali metal borate;
(b) an oil-soluble sulfur-containing compound; and
(c) a zirconium salt of a carboxylic acid or mixture of carboxylic acids.

2. The composition of claim 1 wherein said lubricating composition comprises:

(a) 0.1 to 60 weight percent alkali metal borate;
(b) 0.06 to 6.0 weight percent sulfur-containing compound; and
(c) 0.01 to 10.0 weight percent zirconium salt.

3. The lubricant composition of claim 2 wherein said sulfur-containing compound is a sulfurized polybutene.

4. The lubricant composition of claim 2 containing from 0.03 to 3.0 weight percent of a phosphorus compound.

5. The lubricant composition of claim 4 wherein said phosphorus compound is a mixture of oleylammonium dibutylphosphate and oleylammonium dibutyl monothiophosphate.

6. The lubricant composition of claim 4 wherein said phosphorus compound is a mixture of dodecylammonium dihexylphosphate, dodecylammonium dihexylmonothiophosphate, and dodecylammonium dihexyldithiophosphate.

7. The lubricant composition of claim 5 wherein said zirconium salt is the zirconium salt of 2-ethylhexoate.

8. The lubricant composition of claim 7 wherein said borate is a potassium triborate.

* * * * *